United States Patent [19]

Johnson

[11] 4,032,436

[45] June 28, 1977

[54] PARTICLES SIZING

[76] Inventor: Kenneth I. Johnson, 19 Torreyside Road, Brockton, Mass. 02401

[22] Filed: Oct. 23, 1975

[21] Appl. No.: 625,253

[52] U.S. Cl. ..... 209/1; 209/233; 209/237; 73/432 PS

[51] Int. Cl.[2] ..... B07B 1/00

[58] Field of Search ..... 209/1, 2, 233, 239, 209/237, 235; 73/432 PS

[56] References Cited

UNITED STATES PATENTS

| | | | |
|---|---|---|---|
| 1,999,312 | 4/1935 | Zeissl | 209/239 X |
| 2,063,506 | 12/1936 | Johnson | 209/239 X |
| 2,297,169 | 9/1942 | Russ | 209/2 X |
| 2,782,926 | 2/1957 | Saxe | 209/237 |
| 3,494,217 | 2/1970 | Tanaka | 209/1 X |
| 3,943,754 | 3/1976 | Orr | 73/432 PS X |

FOREIGN PATENTS OR APPLICATIONS

| | | | |
|---|---|---|---|
| 893,721 | 10/1953 | Germany | 209/239 |
| 36,544 | 10/1968 | Japan | 209/233 |

*Primary Examiner*—Robert Halper
*Attorney, Agent, or Firm*—Jerry Cohen; Charles Hieken

[57] ABSTRACT

Sieve analysis and fineness modulus of particles are adjusted in bulk, without breakdown into size fractions and reblending to tailor a feed product for a given application such as asphalt sand or concrete sand by adjusting the rate of largest size cut and smallest size cut removal in a way to modify the distribution of intermediate fractions.

5 Claims, 3 Drawing Figures

PARTICLES SIZING

BACKGROUND OF THE INVENTION

The present invention relates to particle sizing and more particularly to adjusting sands for particular applications such as use in concrete sand or asphalt sand or filter sand.

Particulate materials comprise a size distribution with size cuts, according to the U.S. standard Mesh sizes of 200 mesh, 100 mesh, 50 mesh, 30 mesh, 16 mesh, 8 mesh, and 4 mesh (per inch) and a ⅜-inch spacing between mesh size. A sieve analysis includes running a grab sample through a series of test sieves of such sizes and measuring the percent retained on each of the sieves. An additional indicator, called fineness modulus (F.M.) is the summation of accumulated weight percentages retained on the successive sieves yielding a number in excess of 100 percent, and divided by 100 percent to produce a number which is usually on the order of 2.01–3.50. F.M. indicators are usually confined to concrete sands and do not include the 100 × 200 mesh value. Asphalt an mason sand FM indicators as I have intended, do include the 100 × 200 mesh value. The invention is applicable to particles of all kinds including sands, ores, abrasives and other mineral and metal powders and food kernals, crumbs, oats, seeds and grains.

Very often particle handling processes, more particularly for sands, are run very inefficiently in that there may be excessive classification and blending, or in the alternative waste, because a specific application, such as concrete making or asphalt requires a closely defined sieve analysis and fineness modulus for the particular material (sand) used.

It is an important object of the invention to overcome such difficulties of the prior art and provide efficient materials usage.

It is a further object of the invention to provide a simple process for particulate material handling in the quarry, warehouse or the storage area, consistent with the preceding object.

It is a further object of the invention to accommodate blends as well as single feeds, consistent with one or more of the preceding objects.

SUMMARY OF THE INVENTION

In accordance with the invention a sole or blended feed having a known sieve analysis is continuously fed in a regulated manner to a bin with overflow and normal withdrawal passage, the rate of overflow being determined by control of the normal withdrawal. The predetermined normal withdrawal is taken upon a conveyor to a largest size screen device. Typically, the largest size screening is plus 16 mesh. The material passing 16 mesh is combined with the original overflow and taken to a further classifying device to remove predetermined tonnage of excess minus 100 mesh or minus 200 mesh, depending on the particular application. The remainder is the final product. There will be a predetermined 16 mesh material in the overflow, and hence in the final product and this shifts distribution of the remaining fractions within the product.

It has been discovered that such control can be utilized with practical effectiveness in commercial processes to eliminate the need for more costly specific hydraulic classifying and/or screening and blending or the higher inherent waste factors normally encountered without such specific classifying and/or screening and blending.

Other objects, features and advantages will be apparent from the following detailed description of preferred embodiments taken in conjunction with the accompanying drawing in which:

DETAILED DESCRIPTION OF PREFERRED EMBODIMENTS

Figure 1:
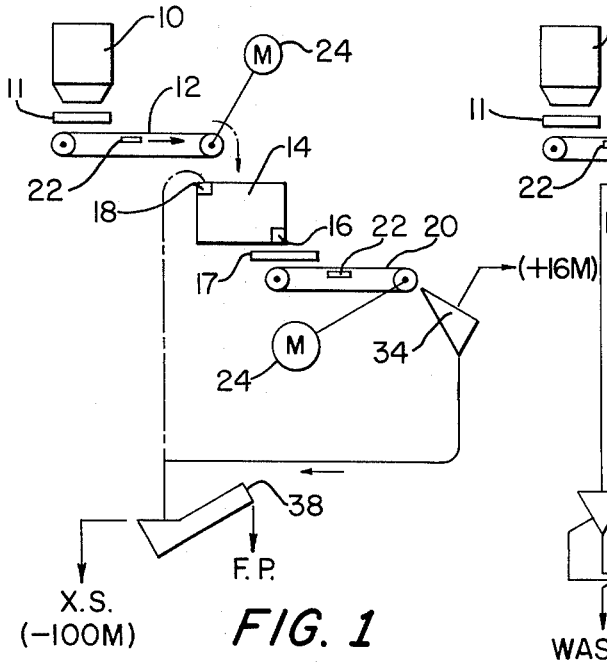
FIGS. 1–3 are alternative flow charts illustrating several preferred embodiments of the invention.

Referring now to FIG. 1 of the drawing, there is shown a feed hopper 10, a feeder 11, a first conveyor 12 with a scale 22, a bin 14 with a normal removal bottom outlet 16, and feeder 17, and an overflow outlet 18, a conveyor 20 with a controlling scale 22 and speed control drive motors 24 for conveyors 12 and 20, a coarse size (e.g., 16 mesh) screen 34 removing coarse particles, a final product fine classifier 38, usually a spiral classifier for passing excessively small size (e.g., minus 100 mesh) waste tonnage, as indicated at XS. Adjusting speed of the motor 24 determines speed of conveyor 12 and 20 and hence the amount of predetermined feed (F) to bin 14 normal removal from bin 14 at a rate G via 16, 17, 20 and consequently overflow at 18 a rate (F)−(G). Plus 16 mesh waste is at a rate (H) and the recombining flow of material at classifier 38 is (F)−(G)+(G)-−(H) or (F)−(H) and removal of fines (XS) at 38 leaves (FP) rate as equal to (F)−(H)−(XS). The invention utilizes control of diversion and recombining rates in determining a proportion of total feed (F) to be removed to a parallel flow path containing a gross size screen such that it will contain enough of the gross size particles to be screened out (at rate H) to provide a resultant which can be recombined with the undiverted (F)−(G) flow to define a specification product, subject to further slight modification by fines removal. Water requirements for components 34 and 38 are an important factor in the economics of classification processes and are discussed below. In any of the embodiments of the invention a dewatering tank may be placed in circuit between two wet components to limit unnecessary throughput of water in the downstream component.

Figure 2:
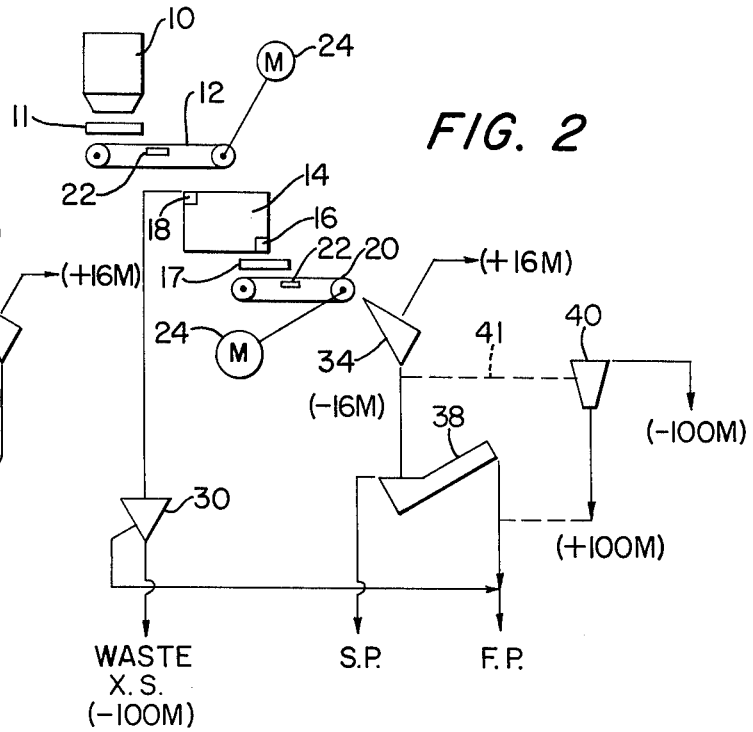

FIG. 2 shows a variant of the FIG. 1 flow sheet in which the spiral classifier placement is in the +16M diversion path while the overflow path from 18 contains a dry air separation device for removal of fines. The spiral classifier 38 may, optionally be replaced by a cyclone separator 40.

Figure 3:
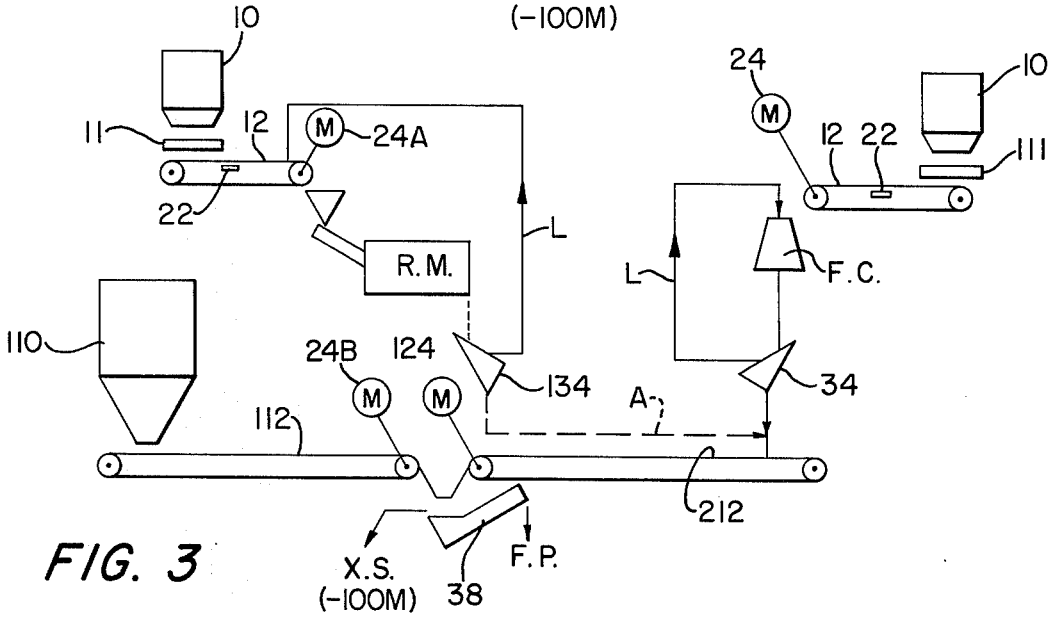

FIG. 3 shows flow sheets for blending flows from conveyors 112 and 212 to a common spiral classifier 38 for delivery of a blended finished product FP after removal of fines (XS). The conveyor 112 may receive flow from a simple bin if the feed from conveyor 212 has a Z characteristic (as explained below) of about 1.0. Otherwise the FIG. 1 circuit (excepting the classifier 38 portion) may be substituted for bin 110.

The conveyor 212 receiver output of a fines crusher F.C. or rod mill R.M. which reduces ⅜ × 16 "waste" to usable finer mesh sizes, and comprising a 4–10 mesh screen at 134 or 234 and recycle of legs L.

For practical reasons, each blend component has its own circuit. Each component has different characteristics that must complement each other in the blending stage. Where excess −100M is eliminated the equation is:

$$X_2 = \frac{X_1(t_1 - t_p)(A_1 + B_1 + C_1 + D_1 + E_1 + F_1)}{(tp - t_2)(A_2 + B_2 + C_2 + D_2 + E_2 + F_2)}$$

where, $t_p$ is between $t_1$ and $t_2$ at blending stage.

If $t_1$ of component 1 original feed is greater than the required $t_1$ at blending stage, then the FIG. 1 circuit is required. Similarly $t_2$ is evaluated. If $t_2$ of component 2 feed is less than tp, a blend ratio will result when component 2 is handled or flowed as is a predetermined rate per the above quotation. A blend ratio is subject to two tests: 1. Availability (tph) of each component — $x_1$ and $x_2$. 2. Product sieve analysis —compatibility to specification sieve analysis. Component availability: If component 1 ($x_1$ tph) is used as base in equation and if $x_2$ exceeds availability, then component 2 ($x_2$ tph) must be used as base. Solving for $x_1$ tph rate is done, said value will be less than availability rate of component 1. There can be instances where it is mandatory to maximize usage of the above component 1. The economics must be proven, however. Maximum utilization of available components 1 and 2 requires maximum utilization of deficient fractions, typically 16 × 100, and determining the amount of +16M that is in excess, or 1-Z. One must determine if excess +16M is to be removed from either or both components. The final decision will be based usually on yield — the calculations must be made for all three possibilities. The above equation can be re-written as follows:

keeping in mind $t = \frac{6A + 5B + 4C + 3D + 2E + F}{A + B + C + D + E + F}$ $$X_2\, tp\, [Z_2(A_2 + B_2 + C_2) + D_2 + E_2 + F_2] - [Z_2(6A_2 + 5B_2 + 4C_2) + 3D_2 + 2E_2 + F_2] =$$

$$X_1\, [Z_1(6A_1 + 5B_1 + 4C_1) + 3D_1 + 2E_1 + F_1] - tp[Z_1(A_1 + B_1 + C_1) + D_1 + E_1 + F_1]$$

Assignment of specific numbers for different mesh sizes: The numbers in question are based upon an alternate mathematical expression or interpretation of the common procedure used to determine fineness modulus. Fineness Modulus is the sum of the cumulative retained percentage on the normal or desired series divided by 100. In the case of concrete sands (above equation applicable), the sizes of sieves used are normally the No. 4, No. 8, No. 16, No. 30, No. 50 and No. 100. The sieve analysis is normally of the form:

$X_1$% passing 4 mesh (U.S. Series)
$X_2$% passing 8 mesh (U.S. Series)
$X_3$% passing 16 mesh (U.S. Series)
$X_4$% passing 30 mesh (U.S. Series)
$X_5$% passing 50 mesh (U.S. Series)
$X_6$% passing 100 mesh (U.S. Series)

The sum of the cumulated retained percentage is:

$$(100-X_1) + (100-X_2) + (100-X_3) + (100-X_4) + (100-X_5) + (100-X_6)$$

The procedure can also be restated in terms of percent retained on each size mesh:

$X_1$% passing 4 mesh . . . . let $A$ = % retained on 4 mesh
$X_2$% passing 8 mesh . . . . let $B$ = % passing 4 mesh, retained on 8 mesh (4 × 8)
$X_3$% passing 16 mesh . . . . let $C$ = % passing 8 mesh, retained on 16 mesh (8 × 16)
$X_4$% passing 30 mesh . . . . let $D$ = % passing 16 mesh, retained on 30 mesh (16 × 30)
$X_5$% passing 50 mesh . . . . let $E$ = % passing 30 mesh, retained on 50 mesh (30 × 50)
$X_6$% passing 100 mesh . . . . let $F$ = % passing 50 mesh, retained on 100 mesh (50 × 100)

The sum of the cumulated retained percents will now be restated:

$$\begin{array}{l}
100 - X_1 = A \\
\quad + \qquad\quad + \\
100 - X_2 = A + B \\
\quad + \qquad\quad + \\
100 - X_3 = A + B + C \\
\quad + \qquad\quad + \\
100 - X_4 = A + B + C + D \\
\quad + \qquad\quad + \\
100 - X_5 = A + B + C + D + E \\
\quad + \qquad\quad + \\
100 - X_6 = A + B + C + D + E + F \\
\quad + \qquad\quad + \\
\hline
\quad * \qquad\quad **
\end{array}$$

*total is $(100 - X_1) + (100 - X_2) + (100 - X_3) + (100 - X_4) + (100 - X_5) + (100 - X_6)$
**total is $6A + 5B + 4C + 3D + 2E + F$ $$FM = \frac{6A + 5B + 4C + 3D + 2E + F}{100} \qquad \text{Equation 1}$$

Since A + B + C + D + E + F = total percent of +100 mesh, it follows:

$$\frac{A + B + C + D + E + F}{\text{Dec. fraction of +100 mesh}} = 100 \qquad \text{Equation 2}$$

Substituting Equation 2 in Equation 1:

$$FM = \frac{6A + 5B + 4C + 3D + 2E + F}{\dfrac{A + B + C + D + E + F}{\text{Dec. fraction of +100 mesh}}}$$

Simplifying:

$$\frac{FM}{\text{Dec. fraction of 100 mesh}} = t = \frac{6A + 5B + 4C + 3D + 2E + F}{A + B + C + D + E + F}$$

Test to determine if excess +16M removal is from:

1. Component 1 — $Z_2 = 1.0$; solve for $Z_1$
2. Component 2 — $Z_1 = 1.0$; solve for $Z_2$
3. Both components — $Z_1 = Z_2$ The practice of the invention in accordance with this fundamental approach is illustrated in the following non-limiting examples of its practice.

EXAMPLE I — CONCRETE and ASPHALT SANDS (With reference to FIG. 1)

A determination of allowed sizing of a concrete sand is typically as follows:

A finished product is expressed according to the following equation (I):

$$\frac{6AZ_1 + 5BZ_2 + 4CZ_3 + 3DZ_4 + 2EZ_5 + FZ_6}{AZ_1 + BZ_2 + CZ_3 + DZ_4 + EZ_5 + FZ_6} = tp$$

For concrete ssand, or for asphalt or mason sand, the equation becomes:

$$\frac{7AZ_1 + 6BZ_2 + 5CZ_3 + 4DZ_4 + 3EZ_5 + 2FZ_6 + GZ_7}{AZ_1 + BZ_2 + CZ_3 + DZ_4 + EZ_5 + FZ_6 + GZ_7} = t_p \quad \text{(IA)}$$

where, in the concrete sand and asphalt sand equations, A is the amount of finished product specification minus three-eighth inch, plus 4 mesh (in weight percent) B is the minus 4, plus 8 mesh amount (i.e., 4 × 8), $C$ is 8 × 16, $D$ is the 16 × 30, $E$ is the 30 × 50, $F$ is the 50 × 100, $G$ is the 100 × 200 [for the asphalt sand equations] desired in the finished product, $Z_1$ is the fractional value of ⅜ × 4 mesh after removing (1 minus $Z_1$) times the original amount of $A$ which was in the feed, and $Z_2$, $Z_3$, $Z_4$, $Z_5$, $Z_6$ and $Z_7$ are corresponding fractional remainder coefficients. The symbol $t_p$ is fineness modulus divided by the decimal fraction of plus 100 mesh of the above concrete sand equation (or whatever constitutes a specification's smallest significant size) in the end product.* The equation is simplified to avoid prohibitive expenses of plant design and utilization of operating skills which would be required if each parameter were to be determined and utilized. The simplification includes taking the $Z_4$ through $Z_6$ values as unity for a case of concrete sand and $Z_4$ through $Z_7$ for asphalt sand mixing. [In other cases $Z_1$ through $Z_4$ and $Z_6$ can be unity.] Further $AZ_1 + BZ_2 + CZ_3$ may be taken as an entity (whereby $Z_1 = Z_2 = Z_3 = Z$) and the simplified equation is:

$$\frac{6AZ + 5BZ + 4CZ + D + E + F}{Z(A + B + C) + D + E + F} = tp \quad \text{(II)}$$

solve for Z:

$$Z = \frac{D(tp - 3) + E(tp - 2) + F(tp - 1)}{A(6 - tp) + B(5 - tp) + C(4 - tp)} \quad \text{(III)}$$

* e.g. 100M — concrete; 200M — asphalt and masonry sands

Then the resolved Z can be substituted in equation II from equation III.

Taking an available feed which has $A = 1$ percent, $B = 18$ percent, $C = 22.5$ percent, $D = 16.5$ percent, $E = 11.5$ percent, $F = 10.5$ percent; a product target of 2.70 fineness modulus 7 percent minus 100 mesh waste allowable and an input feed ($F$) rate at 100 tons per hour, the following solutions are made.

First, equation III is used to solve for $Z = 0.439193$ in this case and therefore the plus 16 mesh fraction in the product Z(A+B+C) should be 18.2265 tons per hour. The tonnage diverted to screen 34 is 100 (1−Z) or 56.0807 tons per hour (TPH), containing 23.27 TPH of +16 mesh that is removed. The minus 16 mesh combines with 100 Z tons that overflowed from bin 15 at (F)−(G) rate. The combined tonnage flowing to final classifier 38 will be: $ZA + ZB + ZC + D + E + F +$ minus 100M tonnage. [Equation IV]. This tonnage minus:

$$\frac{ZA + ZB + ZC + D + E + F}{\text{dec. fraction + 100 mesh of desired production}} = \text{tons of minus 100 Mesh that is excess} \quad \text{[V]}$$

Production will be 60.996 tons per hour and minus 100 mesh wasted will be 15.730 tons per hour. The predicted sieve analysis will be 100 percent passing ⅜ inch screen, 99.28 percent passing a 4 mesh screen, 86.32 percent passing an 8 mesh screen, 70.12 percent passing a 16 mesh screen, 43.07 percent passing a 30 mesh screem, 24.21 percent passing a 50 mesh screen, and 7 percent minus 100. The sieve analysis satisfies the specification. The fineness modulus checks out at 2.70.

The variable speed conveyor 12 controls tons per hour withdrawal rate which is measured or monitored by the conveyor scale. The conveyor belt speed then is determined by $X(1-Z)$ ton per hour withdrawal, where $X$ is plant input handled by conveyor 12. In the above example, $X = 100$ TPH. Further, in the example above, the tonnage of excess minus 100 mesh is to be 15.73 tons per hour and production of specification sand is at the rate of 60.996 tons per hour.

Specification sand production can be monitored by a conveyor belt scale; a quality control would be monitored by sieve analysis. Classifier phase controls the excess minus 100 mesh to be wasted is adjusted when necessary. F.M. determinations would be made, incidentally, from time to time.

EXAMPLES II – VI

Using A through F values and 100 tph feed rate in the above example I, and variations of allowable minus 100 mesh weight percentages typical of commercial practice,

| | II | III | IV | V | VI |
|---|---|---|---|---|---|
| FM/%-100M | 2.85/10 | 2.85/6 | 2.55/10 | 2.7/7 | 2.55/6 |
| Z | .7130 | .5605 | .3812 | .4392 | .2920 |
| (G) Flow to 16M screen 100(1-Z) (TPH) | 28.702 | 43.949 | 61.876 | 56.08 | 70.962 |
| (H) Excess + 16M Wasted (TPH) | 11.911 | 18.239 | 25.678 | 23.27 | 29.380 |
| (FP) Production: $\frac{D+E+F+Z(A+B+C)}{\text{Dec. fraction of +100M in product}}$ (TPH) | 75.654 | 65.703 | 60.357 | 60.996 | 53.851 |
| (XS) Excess minus 100M Wasted (TPH) | 12.434 | 16.058 | 13.964 | 15.73 | 16.769 |
| Predicted Sieve Analysis: | | | | | |
| %-3/8M | 100 | 100 | 100 | 100 | 100 |
| %-4M | 99.06 | 99.15 | 99.37 | 99.28 | 99.46 |
| %-8M | 82.09 | 83.79 | 88.00 | 86.32 | 89.70 |
| %-16 | 60.89 | 64.60 | 73.79 | 70.12 | 77.50 |
| %-30M | 39.08 | 39.48 | 46.45 | 43.07 | 46.86 |
| %-50M | 23.88 | 21.98 | 27.39 | 24.21 | 25.50 |
| %-100M | 10.00 | 6.00 | 10.00 | 7.00 | 6.00 |

-continued

| | II | III | IV | V | VI |
|---|---|---|---|---|---|
| FM | 2.85 | 2.85 | 2.55 | 2.70 | 2.55 |
| Water requirements (GPM): a. Screening at 16M (Minimum requirement: 70% water by wt.) | 267.89 | 410.2 | 577.51 | 523.41 | 662.31 |
| b. Classification phase for excess −100M removal (minimum requirement 65% water by wt.) (total) | 654.38 | 607.37 | 552.11 | 570.0 | 524.0 |
| Water contained in −16M fraction | 255.98 | 391.96 | 551.83 | 500.0 | 632.93 |

Water volume contained in −16M slurry from screen 34 will sometimes exceed minimum water requirements for classifier operation; the higher water condition prevails in determining overflow water. Classifier (−100M control) selection is normally based upon water GPM to be overflowed (wasted) which is approximately the water in classifier feed minus sand prod. rate (tph). The finished sand as discharged by the spiral classifier has approximately 20% water by weight which is approximately one gallon per ton of sand per hour.

If the invention is not used, a sand tank water classifier must be used, 25% solids slurry is maximum, and a 1200 gallon per minute usage of water is entailed per 100 tph of plant feed. Provisions for possible rising current classification would increase water needs further by 200–350 GPM to prohibit premature settling of fines.

If a mechanical air separator is to be used to control −100M of overflow 18, the settling pond or thickener input will be from the spiral classifier handling minus 16M from the screening stage.

| | IIA | IIIA | IVA | VA | VIA |
|---|---|---|---|---|---|
| FM/% −100M | 2.85/10 | 2.85/6 | 2.55/10 | 2.7/7 | 2.55/6 |
| −100M from screening stage | 5.74 | 8.79 | 12.38 | 11.22 | 14.19 |
| −100M from balance of plant feed | 14.26 | 11.21 | 7.62 | 8.78 | 5.81 |
| −100M required for product | 7.57 | 3.94 | 6.04 | 4.27 | 3.23 |
| −100M to be wasted | 12.43 | 16.06 | 13.96 | 15.73 | 16.77 |
| Water in −16M slurry (GPM) | 255.98 | 391.96 | 551.83 | 500.14 | 632.93 |

If it is elected to remove (waste) all −100M from the −16M slurry, then the mechanical air separator will be used to retain −100M required for product sand. Therefore the effluent to a settling pond or thickener would be from the spiral classifier;

| | IIB | IIIB | IVB | VB | VIB |
|---|---|---|---|---|---|
| FM/% −100M | 2.85/10 | 2.85/6 | 2.55/10 | 2.7/7 | 2.55/6 |
| −100M (TPH) | 5.74 | 8.79 | 12.38 | 11.22 | 14.19 |
| Water (GPM) | 244.17 | 373.72 | 526.15 | 476.87 | 603.55 |
| % solids by wt. | 8.6% | | | | |

If it is elected to retain −100M in the spiral classifier that is required for product, then flow to settling pond or thickener is:

| | | | | | |
|---|---|---|---|---|---|
| FM/% −100M | 2.85/10 | 2.85/6 | 2.55/10 | 2.7/7 | 2.55/16 |
| −100M (TPH) | 0 | 4.85 | 6.34 | 6.95 | 10.96 |
| Water (GPM) | | 369.78 | 519.81 | 469.92 | 629.70 |

The invention permits a producer to make a full evaluation of proposed product variations (FM and sieve analysis) versus market requirement; process flow sheet, plant design, and water source and effluent recycle needs. Equipment types and capabilities can be defined.

Sand classifying tanks are normally used to classify, remove excess portions and blend; the tank input is normally the total input. Such units require a feed slurry consistency of about 25% solids by weight. To prohibit premature settling of the finer fractions in the coarser fraction zones, additional water is introduced internally — this phase is termed rising — current classification — at a rate that may add water requirements of 200–350 GPM. Total water potential is then 1400–1550 GPM.

The selection or application of a sand water classification tank is based upon the water requirements of approximately 75% by weight of feed slurry condition. All of the plant feed must enter the sand classifying tank. The tank operating controls are not operated on the basis of precise knowledge of the sieve analysis of the feed and precise knowledge of how much of the excess fractions must be removed.

The invention provides an alternate technique of producing specification sand(s) with considerable reduction of water. The alternative flow sheet is shown.

The water tabulations may be made as follows. Removal of excess —100M (efficiently) in spiral classifiers is a function of turbulence and hence settling time plus velocity of effluent overflowing to waste. Specific gravity of slurry in a settling zone is also critical especially in "high slimes" feed, that is, presence of considerable −200M. The slimes exert a heavy media effect that can prohibit settling of some coarser fractions that will be lost in overflow waste.

Spiral classifiers are used to dewater the finish product discharged by the sand classifying tank. If the specific gravity is excessive, additional water is introduced.

If water is scarce (and plant feed is dry) the flowsheet made possible by the present invention permits the use of spiral classifier to remove −100M from the −16M slurry from screening phase and mechanical air classifier(s) to remove excess −100M from the balance of plant feed. Therefore, process water requirements, effluent and re-cycle costs can now be costed in determining the plant product and yields versus market considerations.

EXAMPLE VII (FIG. 3)

If the +16 waste tonnage is prohibitive or undesired or if there is no market for the +16M waste, one can consider a supplement phase to utilize same as feed to a fines generating device. The supplement may be the product from a fines generating device such as a mill or crusher. The problem then is, what should be the feed rate to the crusher or mill and what should be the t factor of the crusher or mill circuit?Assuming no +16M waste is our object, Z factor of the sand component is 1.00.

EXAMPLE 3

1. Sand $A_1 = 1$ $B_1 = 18.0$ $C_1 = 22.5$ $D_1 16.5$ $E_1 = 11.5$ $F_1 = 10.5$ Then, $$t_1 = \frac{6A + 5B + 4C + 3D + 2E + F}{A + B + C + D + E + F} = 3.3625$$

2. Crusher (assuming granite)

a. 16M circuit $A_2 = 0$ $B_2 = O$ $C_2 = O$ $D_2 = 21.11$ $E_2 = 24.00$ $F_2 = 16.34$ Therefore, $$t_2 = \frac{3D_2 + 2E_2 + F_2}{D_2 + E_2 + F_2} = 2.0776,$$

and $$X_2 = \frac{x_1(t - tp)(A_1 + B_1 + C_1 + D_1 + E_1 + F_1)}{(tp - t_2)(A_2 + B_2 + C_2 + D_2 + E_2 + F_2)}$$

where $x_1$ = tons per hour of sand $x_2$ = crusher circuit capacity required $t_1$ = $t$ factor of sand product $t_2$ = $t$ factor of crusher circuit product $tp$ = $t$ factor of finish blend product of sand and crusher circuit let $x_1 = 100$ ton per hour $tp = 2.70/.93 = 2.9032$ $t_1 = 3.3625$; $\Sigma A_1 - F_1 = 80.00$ $t_2 = 2.0776$; $\Sigma A_2 - F_2 = 61.45$ substitute and solve:

$x_2 = 72.42$ TPH crusher circuit capacity

1. Production of sand 133.873 TPH
2. Estimated prod. sieve analsysis
   100% minus ⅜ inch
   99.25 minus 4 Mesh
   85.81 minus 8 Mesh
   69.00 minus 16 Mesh FM checks out at 2.70
   45.26 minus 30 Mesh
   23.68 minus 50 Mesh
   7.00 minus 100 Mesh
3. −100 mesh wasted:

| | |
|---|---|
| −100 mesh in sand portion of blend | = 20.000 tph |
| −100 mesh in crusher portion of blend | = 27.198 |
| Total −100 in blend | 47.918 tph |
| less −100M in product −133.873 × .07 | = 9.371 |
| −100 waste | 38.547 tph |

4. Material balance: Production + waste = total blend feed 133.873 + 38.547 = 172.42 TPH

EXAMPLE VIII

A further variation can be made if the cost of a 72.42 tph fines generating circuit is prohibitive and/or if feedstock is not available. Suppose that a 50 tph crusher is affordable; however, sufficient feedstock appears questionable at steady state. Two questions must be resolved:

1. How much new feedstock is required if the ⅜ × 16M waste is used as feedstock?
2. Sand production?

$$Z = \frac{(D_1 + .5D_2)(tp - 3) + (E_1 + .5E_2)(tp - 2) + (F_1 + .5F_1)(tp - 1)}{A_1(6 - tp) + B_1(5 - tp) + C_1(4 - tp)}$$

Substitute and solve:

$Z = 0.8264$ therefore +16M wastes at 7.21 tph

Therefore, 1. new feedstock required is 50.00 −7.21 = 42.79 tph
2. sand production is 111.31 tph Feed stock source analysis indicates that the potential source of feedstock could maintain an average of approximately 25 tph.

Statistical analysis of +16M wasted (Y) vs. crusher (X) input is a linear regression function. The equation for this example is $Y = 23.2745 - 0.3214X$.

Since +16M can be part of feedstock to the crusher, the linear regression equation can be restated to:

$$Y = 23.2745 - 0.3214\,(Y + X^1)$$

where $X^1$ is new feedstock solve for $Y$:

$1.3214Y = 23.2745 - 0.3214X^1$ $Y = 17.6135 - 0.2432X^1$ $X = 25.00$ therefore $Y = 11.53$ tph Therefore crusher capacity must be 36.5328 checking: $FM = 2.70$ and 7% −100M product is obtained $$Z = \frac{(D_1 + .36538D_2)(tp - 3) + (E_1 + .36538E_2)(tp - 2) + F_1 + .36538F_2)(tp - 1)}{A(6 - tp) + B(5 - tp) + C(4 - tp)}$$

Z=0.72209; Feed rate to +16M screen = 100(1−0.7221)=27.79 +16M waste: 27.79 X 0.415 = 11.533

36.5328 tph (FGC input) −11.533 tph(+16M)=24.9995 tph

| | |
|---|---|
| sand production | 97.7592 tph |
| −100 Mesh waste | 27.2402 |
| Total | 124.9994 tph |

Sand feed and new feedstock supplement to crusher = 100 +25 = 125 tph

| Product sieve analysis | |
|---|---|
| 100% — ⅜ | 44.58% — 30 |
| 99.26% — 4 | 23.85% — 50 |
| 85.92 — 8 | 7.00% — 100 |
| 69.34 — 16 | |

The above crusher feed rate of 36.5328 tph includes 25.00 tph of new feedstock. Since budget approval covers a 50 tph crusher, there is a reserve capacity of 50.00−36.53 or 13.47 tph Reserve capacity is not usually desirable for any extended period; additional feed stock sources are usually pursued. The question remains: how much additional feed stock is required for optimizing the crusher usage?

The linear regression equation above may be restated as:

$$Y = 17.6135 - 0.2432X^1$$

where $X^1$ is new feedstock and $Y$ is resulting +16 Mesh waste $X^1 + Y = 50$ tph, FGC capacity $X^1 = 50 - Y$ substitute:

$\therefore Y = 17.6135 - 0.2432\ (50 - Y)$ $0.7568\ Y = 5.45$ $\therefore Y = 7.206$ tph of +16M $X^1 = 50 - 7.206 = 42.794$ tph of new feed stock Summary:

Present new feed stock availability 25.00 tph Future new feed stock requirement for 100% crusher utilization−42.79 tph Future Capabilities:

Production 111.31 tph; +16M waste 7.21 tph −100 waste 31.48 tph

| Product S.A. | |
|---|---|
| 100% - ⅜ | 44.88% - 30M |
| 99.26 - 4 | 23.77% - 50M |
| 85.89 - 8 | 7.00% - 100M |
| 69.19 - 16 | FM = 2.70 |

EXAMPLE IX — FILTER SAND

The invention may also be applied to filter sands, conventionally processed in hydraulic sand sorting equipment with low efficiency and/or control. Conventional criteria for evaluating filter sands comprise "effective size", i.e. mesh size (converted to mm. diameter of equivalent spheres and usually desired in the 0.3–0.6 mm. range) corresponding to 10% sand passsing and a 60% effective size which is divided by the 10% size to give a "uniformity coefficient". Uniformity coefficient is generally required to be below 3.50 for filter sands.

Such desiderata are convertible to a sieve analysis controllable by the process flowsheet equipment of FIG. 1 as follows:

| Sample of Crusher Sand | | | | |
|---|---|---|---|---|
| 99.80% | passing | 4M | 4.760 | mm |
| 87.55% | " | 8M | 2.380 | " |
| 81.62% | " | 10M | 2.000 | " |
| *74.85 | " | 12M | 1.680 | " |
| *68.05 | " | 14M | 1.410 | " |
| *61.47 | " | 16M | 1.190 | " |
| *50.63 | " | 18.71 | .900 | " |
| 47.95% | " | 20 | .840 | " |
| 36.00 | " | 30 | .590 | " |
| 25.90 | | 40 | .420 | " |
| 15.89 | | 50 | .297 | " |
| 5.03 | | 100 | .149 | " |

*interpolated

Following based on 100 tph feed rate

| | | | |
|---|---|---|---|
| +10M | in feed | 18.38 | tph |
| +12 | | 25.15 | " |
| +14 | | 31.95 | " |
| +16 | | 38.53 | " |
| +18.71 | | 49.37 | " |

E.S. of 0.3mm (10% – 50M product)

U. C. of 3.00:

∴ 60% of product passes 0.9 mm (18.71M)

Feed contains 50.63 tph of minus 18.71M or 34.74 tph of 18.71 Mesh by 50M

Then, production is 34.74 ÷ (0.60−0.10)= 69.48 tph

Feed rate minus production rate equals waste rate.

100 − 69.48 = 30.52 tph waste rate

+18.71M in feed is 100 − 50.63 or 49.37 tph

+18.71M in production is 0.40 (69.48) or 27.79 tph

∴ 49.37 − 27.79 = 21.58 tph of XS 18.71M.

+12M in feed is 25.15 tph ∴ remove 21.58tph from the 25.15 tph of +12M

Rate (1-Z) factor = 21.58/25.15 = 0.8581

Tonnage rate to screen removing 21.58 is 85.81.

50M X O waste determination

Sand production 69.48 tph; 10% is 50 × O.

| | |
|---|---|
| 50 M × O in feed | 15.89 tph |
| 50 M × O in product | 6.95 tph |
| | 8.94 tph |

E.S. of 0.30; of U.G. of 3.0 ∴ 60% — 18.71M (0.900mm)

| Mesh | Feed tph | Waste tph | Product tph | Product S. Analysis |
|---|---|---|---|---|
| ⅜× 4 | .20 | .17 | .03 | 100% — ⅜ |
| 4 × 8 | 12.25 | 10.51 | 1.74 | 99.96 — 4 |
| 8 × 10 | 5.93 | 5.09 | .84 | 97.45 — 8 |
| 10 × 12 | 6.77 | 5.81 | .96 | 96.24 — 10 |
| 12 × 18.71 | 24.22 | | 24.22 | 94.86 — 12/16M |
| 18.71 × 20.0 | 2.68 | | 2.68 | 60.00 — 18.71 |
| 20 × 30 | 11.95 | | 11.95 | 56.15 — 20 |
| 30 × 40 | 10.10 | | 10.10 | 38.95 — 30 |
| 40 × 50 | 10.01 | | 10.01 | 24.41 — 40 |
| 50 × 0 | 15.89 | 8.94 | 6.95 | 10.00 — 50 |

-continued

| Mesh | Feed tph | Waste tph | Product tph | Product S. Analysis |
|---|---|---|---|---|
| Totals | 100.00 | 30.52 | 69.48 | |

Note:
43.71% of +18.71 Mesh in feed is –excess.
56.26% of –50 Mesh in feed is –excess.

| Plant Feed Rate | Production Rate | Plant Feed Rate | Production Rate |
|---|---|---|---|
| 100 (100.75) | 69.48 (70.00) | 60 (43.18) | 41.69 (30.00) |
| 90 (86.36) | 62.53 (60.00) | 55 (35.98) | 38.21 (25.00) |
| 80 (71.96) | 55.58 (50.00) | 50 (28.79) | 34.74 (20.00) |
| 75 (64.77) | 52.11 (45.00) | 45 (21.59) | 31.27 (15.00) |
| 70 (57.57) | 48.64 (40.00) | 40 (14.39) | 27.79 (10.00) |
| 65 (50.37) | 45.16 (35.00) | 35 | 24.32 |

feed rate (F) at conveyor 12: 100 tph.
feed rate at 20 : 85.81.
overflow rate at 18 : (100 – 85.81)
gross size (12M) removed : 21.58
fines (–50M) removed : 8.94
FP : 69.48

Using 800 gallons per minute water in screen 34 with 779 thereof passing to 38 and 21 thereof passing off with the +12M solids, and an additional 491 gallons per minute added at 38 to provide 1200 gpm therein.

A further useful aspect of the utilization of the present invention is its tendency to produce greater uniformity of distribution in a sand or other mixture of particles and to maintain what is called in the trade, "spec-in-spec", that is, a given fineness modulus specification can be attained and maintained and a given sieve analysis can be attained and maintained consistent with such fineness modulus. This is in contrast to experience with state of the art processes and equipments which are often characterized by a floating sieve analysis of end product, or high standard deviation thereof, even though a desired fineness modulus is maintained. A still further useful aspect of the invention is its tendency to produce better uniformity coefficients and better uniformity overall, i.e. tending to even up the distribution of particles across the range of size cuts in a given specification.

This is illustrated in the following table giving statistical analysis of 40 feedstock sands and simulated process results obtainable in accordance with the present invention adjusted to produce concrete or asphalt sands. In the tables $\bar{x}$ is the "chi" factor of statistical analysis, $s_{\bar{x}}$ is standard deviation and $s_x$ is standard error of the mean (i.e., $s_x//n$,where $n$ is a positive integer greater than 1.0).

| Mesh O'pg | Feedstock % Passing x | Feedstock % Passing $S_x$ | Feedstock % Passing $S_{\bar{x}}$ | FINISHED PRODUCT Concrete % Passing Spec. | Concrete x | Concrete $S_x$ | Concrete $S_{\bar{x}}$ | Asphalt % Passing Spec. | Asphalt x | Asphalt $S_x$ | Asphalt $S_{\bar{x}}$ |
|---|---|---|---|---|---|---|---|---|---|---|---|
| ⅜" | 100 | 0 | 0 | 100 | 100 | 0 | 0 | 100 | 100 | 0 | 0 |
| 4 | 99 | 0 | 0 | 95–100 | 99.46 | .122 | .02 | 95–100 | 99.22 | .14 | .02 |
| 8 | 72.61 | 6.82 | 1.08 | 80–100 | 85.75 | 2.10 | .33 | 72–90 | 79.43 | 2.39 | .38 |
| 16 | 48.73 | 7.85 | 1.24 | 50–85 | 73.05 | 2.75 | .43 | 54–70 | 61.04 | 1.91 | .30 |
| 30 | 34.94 | 6.50 | 1.03 | 25–60 | 42.18 | 1.97 | .32 | 30–50 | 40.24 | 1.55 | .24 |
| 50 | 25.34 | 4.63 | .73 | 10–30 | 23.40 | 1.89 | .31 | 24–35 | 27.32 | 2.00 | .32 |
| 100 | 18.05 | 2.62 | .42 | 2–10 | 7.00 | 0 | 0 | 10–20 | 16.79 | 1.07 | .17 |
| 200 | 10.80 | 1.71 | .27 | | | | | 2–8 | 6.00 | 0 | 0 |

There has been provided then in several embodiments process and apparatus for controllable, economical production of sand. The foregoing control equation (I) may be expressed for any number of coefficients as follows:

$$t = \frac{(N)\,\theta_1 Z_1 + (N-1)\,\theta_2 Z_2 \ldots (N-N+1)\,\theta_N Z_N}{\theta_1 Z_1 + \theta_2 Z_2 \ldots \theta_N Z_N}$$

where $t$ is desired fineness modulus divided by the decimal fraction equivalent, with respect to desired finished product tp, of the remainder after diverting fine size flow (XS), (N) is the number of significant size cuts in the desired sieve analysis $\theta$, $\theta_2 \ldots \theta_N$ are the decimal fractions of feed of each size in a series starting from coarsest size represented by $\theta$, and finest size by said $\theta_N$ and $Z_1$, $Z_2 \ldots Z_N$ are fractional remainder coefficients of removal at the various sizes.

It is evident that those skilled in the art, once given the benefit of the foregoing disclosure, may now take numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Method of classifying particles of variegated sizing comprising the steps of, feeding a throughput flow of the particles at a rate (F), divert part of throughput at a rate (G) to a calibrated coarse size selective device and eliminating particles in excess of the calibrated gross size at a first rate (H), feeding the combination of resultant (G)–(H) flow and (F)–(G) flow to a calibrated fine size selected device at a known rate and eliminating particles below said fine size at a known rate (XS), and controlling the rates (G) and (XS) for a given rate (F) to achieve a desired sieve analysis and fineness modulus of resultant product flow at a rate of (F)–(H)–(XS) including control of particle sizes at levels intermediate said coarse and fine size calibrations, the control being implemented in accordance with the finished product describing equation:

$$t = \frac{(N)\,\theta Z + (N-1)\,\theta_2 Z_2 \ldots (N-N+1)\,\theta_N Z_N}{\theta_1 Z_1 + \theta_2 Z_2 \ldots \theta_N Z_N}$$

where $t$ is desired fineness modulus divided by the decimal fraction equivalent, with respect to desired finished product tp, of the remainder after diverting fine size flow (XS), (N) is the number of significant size cuts in the desired sieve analysis, $\theta$, $\theta_2 \ldots \theta_N$ are the decimal fractions of feed of each size in a series starting from coarsest size represented by $\theta$, and finest size by said $\theta_N$ and $Z_1, Z_2 \ldots Z_N$ are fractional remainder coefficients of removal at the various sizes.

2. Method in accordance with claim 1 and further comprising bypassing a portion of feed (F)–(G) around the coarse size classifier to mix directly with feed to the fine size classifier as a supplement to the step of modifying the fractional remainder coefficients.

3. Method in accordance with claim 2 wherein the particles are controlled are sand.

4. Method in accordance with claim 2 wherein the control equation is applied in accordance with the simplified relation:

$$Z' = \frac{\theta_N(t-1) + \theta_{N-1}(t-2) \ldots}{\theta_1(N-t) + \theta_2(N-1-t) \ldots} \text{ and}$$

wherein the so resolved Z' may be substituted for $Z_1$ and $Z_2$ and $Z_3$ and using only the corresponding $\theta$ coefficients while taking all other $Z$ terms equal to unity.

5. Method in accordance with claim 2 wherein a conveyor takes outflows from a receiving bin and overflow from the receiving bin is controlled by conveyor speed to adjust said bypass amount.

* * * * *